United States Patent [19]

Hata

[11] 4,056,931

[45] Nov. 8, 1977

[54] MULTI-CYLINDER INTERNAL COMBUSTION ENGINE AND METHOD OF OPERATION THEREOF

[75] Inventor: Yoshitaka Hata, Fujisawa, Japan

[73] Assignee: Nissan Motor Co., Ltd., Yokohama, Japan

[21] Appl. No.: 578,189

[22] Filed: May 16, 1975

[30] Foreign Application Priority Data

May 21, 1974 Japan ..... 49-57717

[51] Int. Cl.[2] ..... F02B 75/10

[52] U.S. Cl. ..... 60/274; 60/282; 60/285; 123/59 PC; 123/119 EC; 123/119 LR; 123/127

[58] Field of Search ..... 60/282, 285, 274; 123/119 R, 127, 59 PC, 119 LR, 119 EC

[56] References Cited

U.S. PATENT DOCUMENTS

| | | | |
|---|---|---|---|
| 3,785,153 | 1/1974 | Schwing | 60/305 |
| 3,827,237 | 8/1974 | Linder | 60/285 |
| 3,861,366 | 1/1975 | Masaki | 123/119 R |

*Primary Examiner*—Douglas Hart

[57] ABSTRACT

At high and low engine speed ranges cylinders are separately fed with rich and lean mixtures. During medium engine speed the rich mixture is leaned but still remains richer than the stoichiometric mixture.

13 Claims, 8 Drawing Figures

MULTI-CYLINDER INTERNAL COMBUSTION ENGINE AND METHOD OF OPERATION THEREOF

This invention relates to a multi-cylinder internal combustion engine operated on air-fuel mixtures richer and leaner than stoichiometric and a method of operation thereof.

It is well known that an engine operated on an air-fuel mixture of the stoichiometric air-to-fuel ratio emits exhaust gases containing the highest level of noxious nitrogen oxides. In order to decrease the nitrogen oxides emission, it has already been proposed that a multi-cylinder internal combustion engine be operated on an air-fuel mixture far richer than stoichiometric fed into half the cylinders and an air-fuel mixture far leaner than stoichiometric fed into the remaining cylinders. Additionally, exhaust gases discharged from all the cylinders are mixed together and led into an afterburner to burn and oxidize hydrocarbons and carbon monoxide therein.

Difficulties have been encountered, however, in the prior art in that fuel consumption of the multi-cylinder internal combustion engine is inevitably increased due to feed of the far richer air-fuel mixture into half the number of total cylinders.

It is, therefore, an object of the present invention to provide an improved multi-cylinder internal combustion engine and a method of operation thereof capable of decreasing the fuel consumption inherent in the prior art.

Another object of the present invention is to provide an improved multi-cylinder internal combustion engine and a method of operation thereof capable of decreasing the fuel consumption at medium engine speeds where the engine is usually operated.

A further object of the present invention is to provide an improved multi-cylinder internal combustion engine and a method of operation thereof by which the multi-cylinder internal combustion engine is operated on a first air-fuel mixture richer than stoichiometric fed into half of the cylinders and a second air-fuel mixture leaner than stoichiometric fed into the remaining cylinders at low and high engine speed ranges, while the first air-fuel mixture is changed to an air-fuel mixture leaner than the first air-fuel mixture but still richer than stoichiometric when the engine is being operated at medium engine speed range.

Other objects and features of the present invention will become more apparent from the following description taken in conjunction with the accompanying drawings in which like reference numerals and characters designate corresponding parts and elements throughout the drawings in which.

Figure 7:
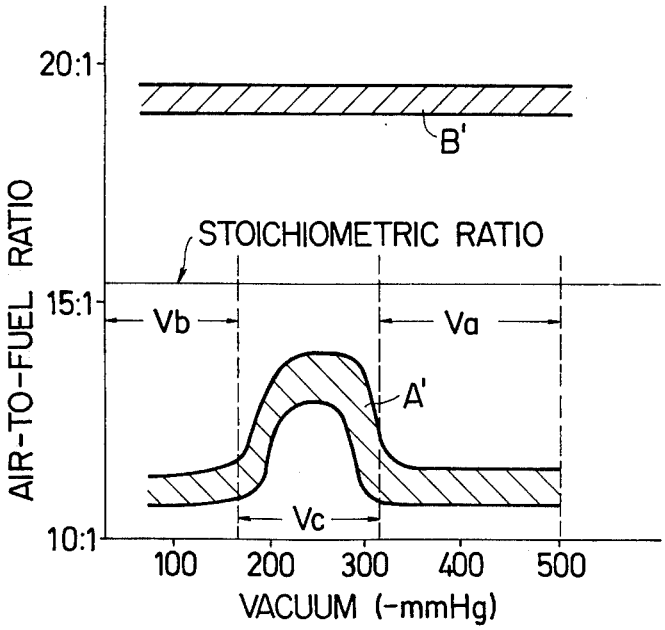
Figure 8:
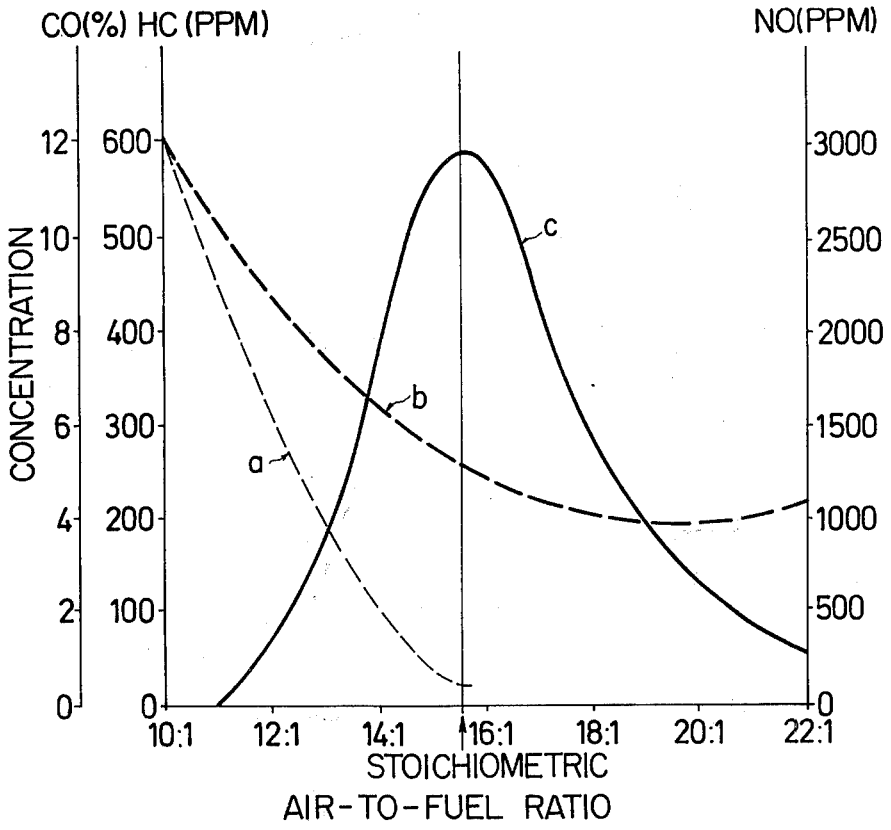

FIG. 7 is a graph showing a typical example of the relationship between air-fuel ratios and intake manifold vacuums, which is attained by the present invention; and FIG. 8 is a graph showing a typical example of the relationship between the concentrations of carbon monoxide, hydrocarbons and nitrogen oxides in the exhaust gases from the internal combustion engine and the air-fuel ratios of the mixtures fed into the engine.

Figure 1:
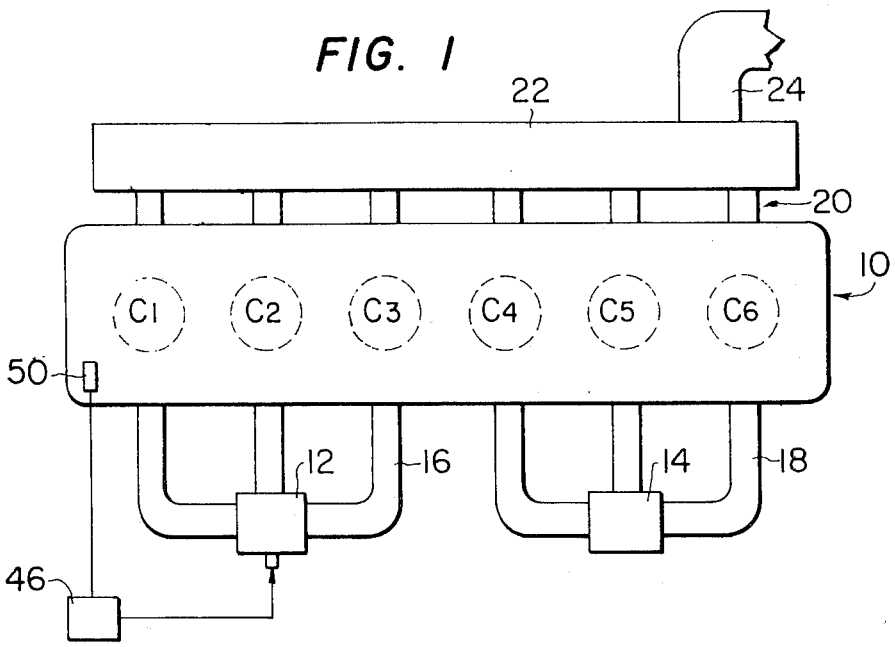
FIG. 1 is a schematic plan view of a first preferred embodiment of the present invention in which a six-cylinder internal combustion engine is equipped with first and second carburetors.
Figure 2:
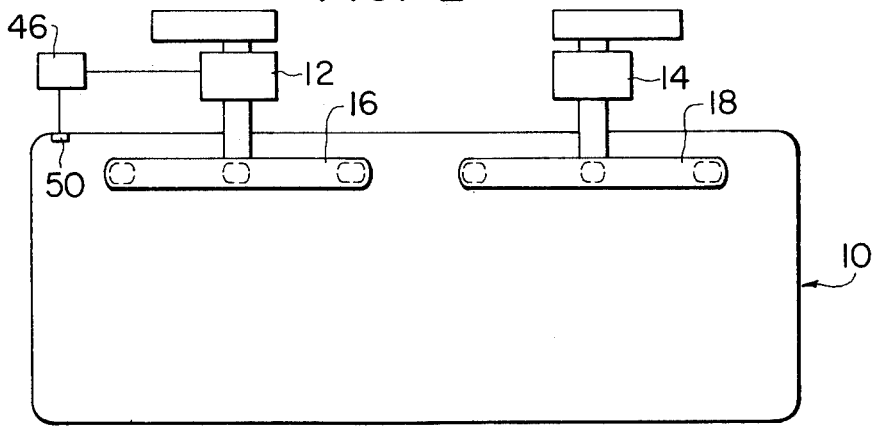
FIG. 2 is a schematic section view of the engine shown in FIG. 1.
Figure 3:
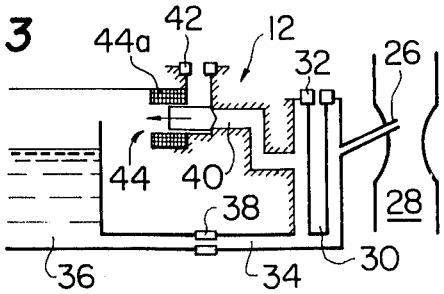
FIG. 3 is a partial schematic section view of the first carburetor used in the embodiment of FIG. 1.

Referring now to FIGS. 1, 2 and 3, there is shown a first preferred embodiment of the present invention in which a six-cylinder internal combustion engine 10 for an automative vehicle (not shown) has a first group of cylinders $C_1$, $C_2$ and $C_3$ and a second group of cylinders $C_4$, $C_5$ and $C_6$. The engine 10 is equipped with a first carburetor 12 which prepares a first air-fuel mixture richer than stoichiometric and a second carburetor 14 which prepares a second air-fuel mixture leaner than stoichiometric. The first carburetor 12 communicates through a first intake manifold 16 with the intake ports (not shown) of the first group of cylinders $C_1$, $C_2$ and $C_3$ to feed the first air-fuel mixture into the cylinders during their intake strokes. The second carburetor 14 communicates through a second intake manifold 18 with the intake ports (not shown) of the group of cylinders $C_4$, $C_5$ and $C_6$ to feed the second air-fuel mixture into the cylinders during their intake strokes. The carburetors 12 and 14, as usual, have air-filters (not numerals), respectively. While, the exhaust ports (not shown) of all the cylinders $C_1$ to $C_2$ communicate in turn through exhaust conduits 20 with an afterburner 22 which purifies noxious constituents in the exhaust gases from the cylinders and discharges clean exhaust gases through an exhaust pipe 24 into the atmosphere. The afterburner 22 may be an exhaust manifold which functions to burn burnable constituents in the exhaust gases.

Illustrated in detail in FIG. 3 is a construction of the first carburetor 12 in which a main discharge nozzle 26 opens into the main venturi portion (no numeral) formed within an air-fuel mixture induction passage 28. The main discharge nozzle 26 in turn communicates with a main well 30. The main well 30 communicates through a main air bleed 32 with the atmospheric air at its top and further communicates through a main fuel passage 34 with a fuel chamber 36 at its bottom. The main fuel passage 34 has a main jet 38 therewithin. Also communicating with the main well 30 is an auxiliary air induction passage 40 which in turn communicates through an auxiliary air bleed 42 with the atmosphere. A normally closed solenoid valve 44 is disposed within the auxiliary air induction passage 40 and arranged to open to allow atmospheric air into the main well 30 through the air induction passage 40 when the solenoid coil **44*a* thereof is energized. The solenoid coil 44*a* of the solenoid valve 44 is electrically connected to a control circuit 46 as shown in FIGS. 1 and 2. The control circuit 46 is in turn electrically connected to an engine speed sensor 50 which produces an electrical signal responsive to engine speed. The control circuit 46 is arranged to energize the solenoid coil 44*a* of the solenoid valve 44 when the electrical signal corresponding to an engine speed within the medium engine speed range is transmitted thereto from the engine speed sensor 50. It should be noted that the sizes of the auxiliary air bleed 42 and the main air bleed 32 of the first carburetor 12 are so selected that the first carburetor 12 can feed the first group of cylinders with an air-fuel mixture leaner than the first air-fuel mixture and richer than stoichiometric, e.g. air-fuel ratios ranging from 12.5:1 to 14.5:1 when the additional air is inducted through the opening of the auxiliary air bleed 42 and the main air bleed 32 into the main well 30 by the vacuum in the air-fuel mixture induction passage 28.**

With the arrangement described hereinbefore, when the engine is operated at the medium engine speed range, the control circuit 46 connected to the engine speed sensor 50 energizes the solenoid coil 44*a* of the normally closed solenoid valve 44 to open it. Atmospheric air is then inducted into the main well 30 through the auxiliary air bleed 32 and the auxiliary air induction passage 40 as well as through the main air bleed 32. As a result, an amount of fuel discharged from the main discharge nozzle 26 by the suction vacuum in the air-fuel mixture induction passage 28 is decreased and therefore the air-fuel mixture fed into the first group of cylinders $C_1$, $C_2$ and $C_3$ is changed into the air-fuel mixture which is leaner than the first air-fuel mixture but still richer than stoichiometric.

Figure 4:
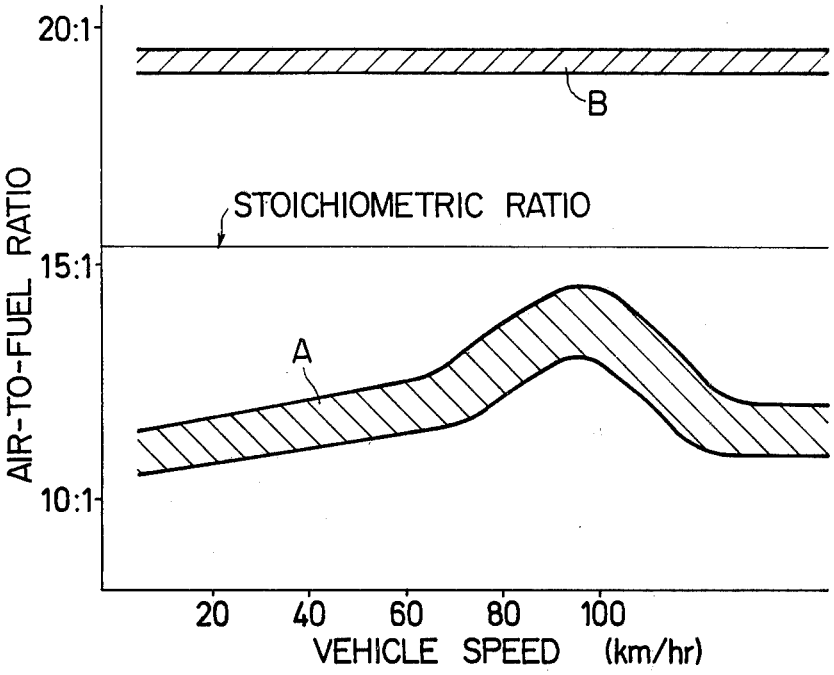
FIG. 4 is a graph showing a typical example of the relationship between air-fuel ratios and vehicle speeds, which is attained by the present invention.

FIG. 4 illustrates an example of the air-fuel ratio ranges of the air-fuel mixtures fed from the carburetors constructed as shown in FIGS. 1 to 3 at various vehicle speeds (in third gear or direct drive gear), in which a range A indicates the air-fuel ratios of the air-fuel mixtures fed from the first carburetor 12 and a range B indicates the air-fuel ratio of the air-fuel mixture fed by the second carburetor 14. As shown, the range A (from the first carburetor 12) changes with the vehicle speeds, but the range B (from the second carburetor 14) is constant through all the vehicle speeds.

Figure 5:
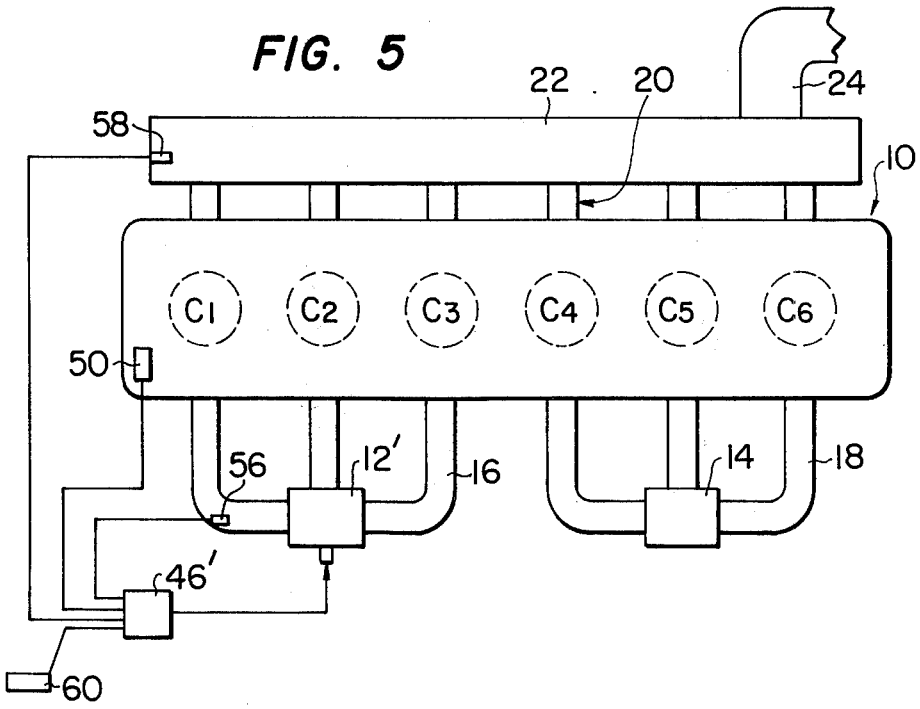
FIG. 5 is a schematic plan view of a second embodiment of the present invention in which a six-cylinder internal combustion engine is equipped with first and second carburetors.
Figure 6:
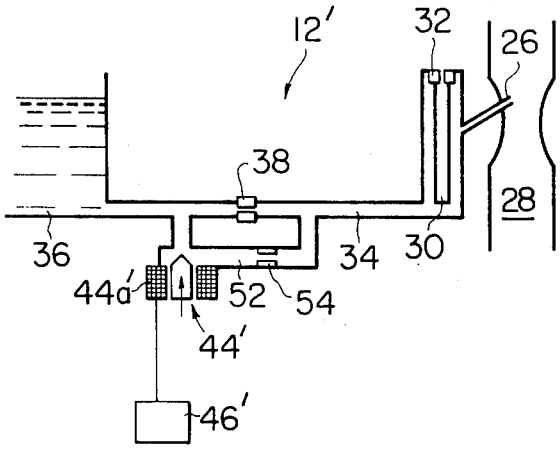
FIG. 6 is a partial schematic section view of the first carburetor used in the embodiment of FIG. 5.

FIGS. 5 and 6 illustrate a second preferred embodiment of the present invention similar to the embodiment shown in FIGS. 1 to 3 except for the construction of the first carburetor 12'. The first carburetor 12' comprises the main discharge nozzle 26 which opens into the main venturi portion (no numeral) formed within the air-fuel mixture induction passage 28. The main discharge nozzle 26 communicates with the main well 30 which in turn communicates with the atmosphere at its top and further communicates through the main fuel passage 34 with a fuel chamber 36 at its bottom. The main fuel passage 34 has the main jet 38 therewithin. An auxiliary fuel passage 52 communicates portions of the main fuel passage 34 upstream and downstream of the main jet 38. The auxiliary fuel passage 52 has an auxiliary jet 54 therewithin. A normally opened solenoid valve 44' is disposed within the auxiliary fuel passage 52 and arranged to be closed to block the auxiliary fuel passage 52 when the solenoid coil 44*a'* of the solenoid valve 44' is energized. The solenoid coil 44*a'* is electrically connected to the control circuit 46' as shown in FIG. 5. The control circuit 46' is connected to the engine speed sensor 50 which produces the electrical signal responsive to the engine speed of the engine 10. The control circuit 46 is arranged to energize the solenoid coil 44*a'* of the solenoid valve 44' when an electrical signal indicative of medium engine speed range is transmitted thereto from the engine speed sensor 50. It should be noted that the sizes of the main jet 38 and the auxiliary jet 54 are so selected that the first carburetor 12 can feed the first group of cylinders with the air-fuel mixture leaner than the first air-fuel mixture but still richer than stoichiometric when fuel to be discharged from the main discharge nozzle 26 is forced to flow only through the main jet 38.

With this arrangement, when the engine 10 is operated at the medium engine speed range, the control circuit 46' connected to the engine speed sensor 50 energizes the solenoid coil 44*a'* of the solenoid valve 44' to close it. Then the fuel flow through the auxiliary fuel passage 52 is blocked and therefore the fuel discharged from the main discharge nozzle 26 flows only through the main fuel passage 34. Thus, the amount of fuel discharged through the main discharge nozzle 26 is reduced to change the first air-fuel mixture into an air-fuel mixture leaner than the first air-fuel mixture but still richer than stoichiometric. It will be noted that the control circuit 46' is further connected to an intake manifold vacuum sensor 56, an afterburner temperature sensor 58 and an engine acceleration sensor 60 in order to modify the operation of the solenoid valve 44' via the signals from the sensors 56, 58 and 60.

While the solenoid valves 44 and 44' in FIGS. 3 and 6 have been shown and described to be operated in response to the signal from the engine speed sensors 50, respectively, the solenoid valves 44 and 44' may be operated in response to other signals such as a signal from an intake manifold vacuum sensor 56.

FIG. 7 illustrates an example of the air-fuel ratio ranges of the air-fuel mixtures fed from the carburetors according to the invention at various intake manifold vacuums, in which a range A' indicates the air-fuel ratios of the air-fuel mixtures fed by the first carburetor 12 or 12' and a range B' indicates those fed by the second carburetor 14. As indicated, the range A' by the first carburetor 12 or 12' approaches stoichiometric air-fuel ratio at medium vacuum range $V_c$ which corresponds to the medium engine speed range, but is far richer than the stoichiometric air-fuel ratio at low and high vacuum ranges $V_a$ and $V_b$ which correspond to low and high engine speed ranges, respectively. However, the range B' from the second carburetor 14 is constantly far leaner than the stoichiometric air-fuel ratio.

As is apparent from the foregoing description, in accordance with the present invention, fuel consumption is considerably decreased while the vehicle is running within the medium speed range where the nitrogen oxides emission level is relatively low due to relatively low combustion temperatures. With reference to FIG. 8 in which curves *a, b* and *c* indicate the concentrations of carbon monoxide, hydrocarbons and nitrogen oxides, respectively in the engine exhaust gases with respect to the air-fuel ratios of the air-fuel mixtures fed into the engine, it will be understood that the engine 10 according to the invention emits exhaust gases containing only a small amount of nitrogen oxides because it is not operated on the stoichiometric air-fuel ratio at any engine speed. Even at the medium engine speed range, it is operated on near, but not stoichiometric air-fuel ratio as clearly shown in FIGS. 4 and 7. Additionally, carbon monoxide and hydrocarbons contained in the exhaust gases from the engine 10 are burned by the afterburner 22 and converted into carbon dioxide and water vapor.

While the engine and operation in accordance with the present invention has been shown and described as using carburetors, it will be readily understood that the engine may be equipped with a similarly arranged fuel injection system.

What is claimed is:

1. A method of operation of a multi-cylinder internal combustion engine having a first group of cylinders consisting of at least half the total number of cylinders and a second group of cylinders consisting of the remaining cylinders, the engine being followed by an afterburner for burning exhaust gases from all the cylinders, comprising:

feeding said first group of cylinders with a first air-fuel mixture richer than stoichiometric;

feeding said second group of cylinders with a second air-fuel mixture leaner than stoichiometric; and feeding said fist group of cylinders with an air-fuel mixture which is leaner than said first air-fuel mixture and richer than stoichiometric only when the engine is operated at medium engine speed range.

2. The improvement according to claim 1, in which said air-fuel mixture which is leaner than said first air-fuel mixture and richer than stoichiometric is produced by induction of additional atmospheric air through an auxiliary air bleed into the main well of the carburetor of the engine in addition to through a main air bleed of the main well.

3. The improvement according to claim 1, in which said air-fuel mixture which is leaner than said first air-fuel mixture and richer than stoichiometric is produced by decreasing the amount of fuel flowing through the main fuel passage which communicates a main discharge nozzle and a fuel chamber of the carburetor of the engine.

4. A multi-cylinder internal combustion engine which has a first group of cylinders consisting of at least half the total number of cylinders and a second group of cylinders consisting of the remaining cylinders, the engine being followed by an afterburner for burning exhaust gases from all the cylinders, comprising:

a first carburetor for feeding said first group of cylinders with a first air-fuel mixture richer than stoichiometric;

a second carburetor for feeding said second group of cylinders with a secone air-fuel mixture leaner than stoichiometric;

means for allowing said first carburetor to feed an air-fuel mixture which is leaner than said first air-fuel mixure and richer than stoichiometric only when the engine is operated at medium engine speed range.

5. A multi-cylinder internal combustion engine according to claim 4, in which said first carburetor includes:

a main fuel passage communicating a main discharge nozzle with a fuel chamber;

a main well disposed in said first passage which communicates with the atmosphere through a main air bleed;

a main jet disposed within said fuel passage between said fuel chamber and said main well.

6. A multi-cylinder internal combustion engine according to claim 5, in which said means includes:

an auxiliary air induction passage communicating said main well of said carburetor with the atmosphere through an auxiliary air bleed;

a normally closed solenoid valve disposed within said air induction passage for blocking the passage and openable to allow induction of atmospheric air into said main well through said air induction passage when the solenoid coil thereof is energized;

a sensor for producing an electrical signal in response to a vehicle operating parameter representing engine speed;

a control circuit electrically connecting said sensor to the solenoid coil of said solenoid valve and arranged to energize the solenoid coil of said solenoid valve when the electrical signal indicating an engine speed within the medium engine speed range is transmitted thereto from said sensor.

7. A multi-cylinder internal combustion engine according to claim 6, in which said sensor includes an engine speed sensor.

8. A multi-cylinder internal combustion engine according to claim 4, in which said first carburetor includes:

a main fuel passage communicating a main discharge nozzle with a fuel chamber;

a main well disposed in said fuel passage which communicates with the atmosphere through a main air bleed;

a main jet disposed within said main fuel passage between said fuel chamber and said main well;

an auxiliary fuel passage communicating portions of said main fuel passage upstream and downstream of said main jet, said passage having therewithin an auxiliary jet.

9. A multi-cylinder internal combustion engine according to claim 8, in which said means includes:

a normally open solenoid valve disposed within said auxiliary fuel passage and arranged to be closeable to block said auxiliary fuel passage when the solenoid coil thereof is energized;

a sensor for producing an electrical signal in response to a vehicle operating parameter representing engine speed;

a control circuit electrically connecting said sensor to the solenoid coil of said solenoid valve and arranged to energize the solenoid coil when the electrical signal corresponding medium vehicle speed range is transmitted thereto from said sensor.

10. A multi-cylinder internal combustion engine according to claim 9, in which said sensor includes an engine speed sensor.

11. A multi-cylinder internal combustion engine according to claim 10, further including an intake manifold vacuum sensor.

12. A multi-cylinder internal combustion engine according to claim 11, further including an afterburner temperature sensor.

13. A multi-cylinder internal combustion engine according to claim 12, further including an engine acceleration sensor.

* * * * *